US007438503B2

(12) United States Patent
Skinner

(10) Patent No.: US 7,438,503 B2
(45) Date of Patent: Oct. 21, 2008

(54) MASK KEEPER

(75) Inventor: Oscar Lane Skinner, 3005 Creek View Ct., Augusta, GA (US) 30907

(73) Assignee: Oscar Lane Skinner, Augusta, GA (US)

( * ) Notice: Subject to any disclaimer, the term of this patent is extended or adjusted under 35 U.S.C. 154(b) by 0 days.

(21) Appl. No.: 11/365,185

(22) Filed: Mar. 1, 2006

(65) Prior Publication Data

US 2006/0204339 A1 Sep. 14, 2006

Related U.S. Application Data

(60) Provisional application No. 60/660,001, filed on Mar. 9, 2005.

(51) Int. Cl.
*B63C 11/02* (2006.01)

(52) U.S. Cl. ..... 405/186

(58) Field of Classification Search ..... 405/186
See application file for complete search history.

(56) References Cited

U.S. PATENT DOCUMENTS 4,051,554 A * 10/1977 Kallman ..... 2/94
4,055,873 A * 11/1977 Kallman ..... 24/3.3
4,220,302 A * 9/1980 Hampton et al. ..... 248/102
4,236,658 A * 12/1980 Kallman ..... 224/250
4,893,381 A * 1/1990 Frankel ..... 24/16 R
4,919,258 A * 4/1990 Perretta ..... 206/5
4,966,322 A * 10/1990 Zagorski et al. ..... 224/267
4,969,239 A * 11/1990 Bruno ..... 24/3.3

* cited by examiner

*Primary Examiner*—Frederick L. Lagman

(57) ABSTRACT

The present invention relates to a structure that allows a diving mask to be attached to a buoyancy control device. By using this structure to attach the mask to the buoyancy control device, this structure provides an easy, fast and simple method of securing a scuba mask so as it is not lost, dropped, broken, stolen, etc., and also keeps the mask readily available in and out of the water. The mask can be easily attached and released.

1 Claim, 1 Drawing Sheet

MASK KEEPER

Figure 1:
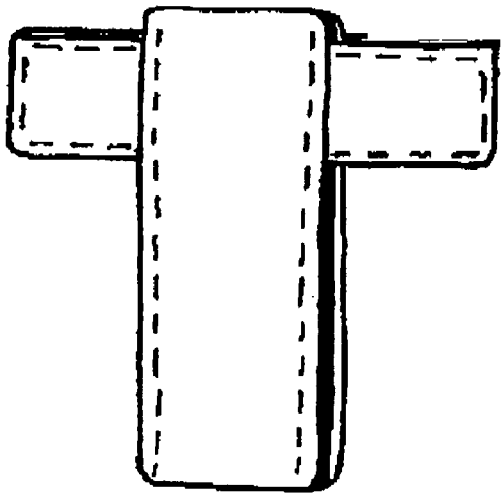

This non-provisional utility patent application is in reference to, and should claim the benefit of, the formerly filed provisional patent application number U.S. 60/660,001 for said invention filed on Mar. 9, 2005.

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

In the sport of Scuba Diving one usually wears a Scuba Mask and a Buoyancy Control Device along with other equipment. While not in use the Scuba Mask is usually laid about in a non-specific area that can result in damage, loss, theft, or the like. The mask keeper solves this problem by attaching the mask to the Buoyancy Control Device.

BRIEF SUMMARY OF THE INVENTION

The Mask Keeper is a device that attaches to the Buoyancy Control Device primarily on the manual inflation hose, but may be affixed elsewhere on the Buoyancy Control Device, and can secure the Scuba Mask to the Buoyancy Control Device.

DRAWING DESCRIPTION

FIG. 1 of the drawing shows a front view of the invention in a closed position.

Note: All drawing measurements and information are approximate. The drawing measurements and the drawing legend are for illustration purposes only and DO NOT represent actual manufacturing specifications. Also, other models of the invention may include hook and loop, button snaps, elastic fabric, elastic rubber or male & female interlocking plastic parts depending on the different specialties which are not included in these illustrations. Drawings are not intended to illustrate the only form of the invention in absolute, but rather to illustrate the general look, nature, and use of the invention.

DETAILED DESCRIPTION OF THE INVENTION

The model illustrated is manufactured by two Velcro straps sewn together in a "T " shape with the top of the "T" encompassing and securing to the manual inflation hose of the Buoyancy Control Device, and the body of the "T" shape being folded up and securing upon itself to create a loop for securing the Scuba Mask strap.

According to the spirit of patent law, the structure of the present invention can be modified according to the different specialties. For example, the way, the first part and/or the second part attach to the buoyancy control device and secure the mask, or by switching each other, or the use of a variety of materials such as hook and loop, button snaps, elastic fabric, elastic rubber or male & female interlocking plastic parts, or by some other modification of the structure of the fixture, or the use of different materials used in the manufacturing of said invention, should all be included in this case. The main purpose of the present invention is to produce fixture equipment that allows the mask to attach and/or release from the buoyancy control device.

What is claimed is:

1. An apparatus for attaching or securing scuba accessories including a scuba diving mask to a manual inflator hose of a scuba buoyancy control device, the apparatus comprising: a T-shaped scuba mask holder, the T-shaped mask holder comprising a first part and a second part; wherein the first part forms the horizontal, top portion of the T-shape and includes hook and loop fasteners and the second part forms the vertical, bottom portion of the T-shape and also includes hook and loop fasteners, the first part and second part sewn together to form the T-shape; wherein the first part is about five inches long and one inch wide and is adapted to wrap around and secure itself to the manual inflator hose of the scuba buoyancy control device via the hook and loop fasteners; and wherein the second part is about five inches long and one inch wide and is adapted to secure the scuba diving mask via the hook and loop fasteners.

* * * * *